US008512073B2

(12) United States Patent
Takano et al.

(10) Patent No.: US 8,512,073 B2
(45) Date of Patent: Aug. 20, 2013

(54) COAXIAL ELECTRIC CONNECTOR

(75) Inventors: Tomohito Takano, Machida (JP); Hidenori Minegishi, Machida (JP)

(73) Assignee: Dai-Ichi Seiko Co., Ltd., Kyoto-shi (JP)

( * ) Notice: Subject to any disclaimer, the term of this patent is extended or adjusted under 35 U.S.C. 154(b) by 0 days.

(21) Appl. No.: 13/453,082

(22) Filed: Apr. 23, 2012

(65) Prior Publication Data

US 2012/0276788 A1 Nov. 1, 2012

(30) Foreign Application Priority Data

Apr. 26, 2011 (JP) ..... 2011-098280

(51) Int. Cl.
*H01R 9/05* (2006.01)

(52) U.S. Cl.
USPC ..... 439/578; 439/582

(58) Field of Classification Search
USPC ..... 439/63, 578–582
See application file for complete search history.

(56) References Cited

U.S. PATENT DOCUMENTS 5,662,480 A * 9/1997 Togashi ..... 439/63
5,772,470 A * 6/1998 Togashi ..... 439/582
7,025,598 B2 * 4/2006 Ikeda ..... 439/63

FOREIGN PATENT DOCUMENTS

JP 2001-43939 A 2/2001

* cited by examiner

*Primary Examiner* — Khiem Nguyen
(74) *Attorney, Agent, or Firm* — Oblon, Spivak, McClelland, Maier & Neustadt, L.L.P.

(57) ABSTRACT

A mating operation mutually between connectors can be easily and precisely carried out with a simple configuration. An insertion reference surface having a predetermined outer-diameter size D1 is provided to extend by a predetermined length in an axial direction on an outer peripheral surface of an inner-side contact among both cylindrical-shaped contacts overlapped with each other in inside/outside in the radial direction. A mutual mating relation is set so that the inner peripheral surface of the outer-side contact has an inner-diameter size D2 (D2≈D1) approximately same as an outer-diameter size D1 of the insertion reference surface of the inner-side contact. The outer-side contact can be smoothly inserted while carrying out positioning by the insertion reference surface of the inner-side contact 13.

4 Claims, 10 Drawing Sheets

COAXIAL ELECTRIC CONNECTOR

BACKGROUND OF THE INVENTION

1. Field of the Invention

The present invention relates to a coaxial electric connector configured so that cylindrical contacts are mutually mated/removed.

2. Description of the Related Art

Generally, in various electric devices, etc., electric connectors for electrically connecting various signal transmitting media such as coaxial cables are widely used. For example, in a coaxial electric connector shown in FIG. 9, a plug connector 2 to which a terminal part of a coaxial cable serving as a signal transmitting medium (see a symbol SC in FIG. 2 showing the present invention) is coupled is configured to be able to be mated/removed in the top-bottom direction of the drawing with respect to a receptacle connector 1 mounted and used on a printed wiring board. Among them, in the receptacle connector 1, a center contact 1*b* for signal transmission and an external contact 1*c* for grounding are approximately-concentrically attached to a plate-like insulating housing 1*a*. An insulating housing 2*a* of the plug connector 2 is formed so as to approximately conically project toward the above described coaxial receptacle connector 1, and a center contact 2*b* for signal transmission and an external contact 2*c* for grounding are approximately concentrically attached to the inside/outside of the insulating housing 2*a*.

Then, when the plug connector 2 serving as the opposing connector is inserted to the receptacle connector 1 downward from the upper side, the distal-end opening part of the external contact 2*c* of the plug connector 2 is configured to be mated with the distal-end opening part of the external contact 1*c* of the receptacle connector 1 so that the parts are overlapped in the inside/outside of the radial direction and locked. More specifically, among the both external contacts 1*c* and 2*c* mated in the above described manner, a lock part 1*d* forming an annular recessed shape recessed toward the inner side of the radial direction is provided on the outer peripheral surface of the inner-side contact 1*c* positioned in the inner side of the radial direction, and a lock part 2*d* having an annular projected shape projecting toward the inner side of the radial direction is provided on the inner peripheral surface of the outer-side conductive contact 2*c* positioned in the outer side of the radial direction. When the above described both connectors 1 and 2 are mated with each other, the lock part 2*d* of the coaxial plug connector 2 side is dropped into the lock part 1*d* of the coaxial receptacle connector 1 side to achieve an engaged state so that the mutual mating state of both of the connectors 1 and 2 can be maintained.

On the other hand, downsizing and height reduction have been recently rapidly developed along with demands for reducing weight, thickness, and size also in such a coaxial electric connector as well as other electronic parts. However, when downsizing and height-reduction are carried out, the alignment upon mating mutually between both the connectors becomes difficult. For example, as shown in FIG. 10, the plug connector 2 serving as the opposing connector is mated with the receptacle connector 1 in an state in which the plug connector 2 is inclined, which may cause damage or a problem in the electric contact performance mutually between both of the connectors 1 and 2.

Furthermore, in the conventional coaxial electric connector, when both of the connectors are to be mated with each other, the inner peripheral surface of the outer-side contact becomes a lightly-press-fitted state with respect to the inner-side contact. Therefore, the outer-side contact is inserted so as to be pushed and expanded toward the outer side of the radial direction. However, in that process, contact mutually between the center contacts of both of the connectors is started approximately at the same time. Therefore, there are problems that load in the mating operation is increased, and the position or the balance of the electric connector in the mating operation easily becomes defective.

SUMMARY OF THE INVENTION

Therefore, it is an object of the present invention to provide a coaxial electric connector with which a mating operation mutually between both connectors can be easily and precisely carried out with a simple configuration.

In order to achieve the above described object, the present invention employs a configuration in which a coaxial electric connector is configured so that a receptacle connector mounted on a printed wiring board and a plug connector coupled to a terminal part of a signal transmitting medium can be mutually mated/removed and is configured so that a distal-end opening part of a cylindrical contact constituting the plug connector is inserted to a distal-end opening part of a cylindrical contact constituting the receptacle connector so as to be overlapped in inside/outside of a radial direction; wherein an insertion reference surface having a predetermined outer-diameter size D1 is formed to extend by a predetermined length L in an axial direction on an outer peripheral surface of an inner-side contact positioned in the inner side of a radial direction among both of the cylindrical contacts; and a mating relation is set so that an inner peripheral surface of the outer-side contact positioned in the outer side of the radial direction among both of the cylindrical contacts has an inner-diameter size D2 (D2≈D1) approximately same as an outer-diameter size D1 of the insertion reference surface of the inner-side contact.

According to the present invention having such a configuration, when both of the connectors are to be mated with each other, first, the inner peripheral surface of the outer-side contact is smoothly inserted while being positioned by the insertion reference surface provided on the outer peripheral surface of the inner-side contact so as to have an approximately same size as the outer-side contact. Unlike conventional cases, the plug connector is not inclined with respect to the axial direction of the receptacle connector, and the outer-side contact is not pushed and expanded to the outer side in the radial direction. Therefore, the inserting operation of the outer-side contact can be stably and precisely carried out, and the insertion force can be suppressed to be small. As a result, the positional stability upon mating mutually between both of the connectors is improved, so-called inclined mating in conventional cases is prevented, a good mating state is obtained, and an electrical contact state is improved.

Moreover, in the present invention, it is desirable that an insulating housing to which the outer-side contact is attached be provided with an approximately-cylindrical-shaped insertion guide part extending in an axial direction along the inner peripheral surface of the inner-side contact.

According to the present invention having such a configuration, when both of the connectors are to be mated with each other, the state in which the inner-side contact is sandwiched between the outer-side contact and the insertion guide part provided in the insulating housing retaining the outer-side contact is achieved, and the state in which movement of both of the connectors after mating is restricted is achieved. As a result, for example, external force caused by, for example, so-called tilting is applied with intermediation of the signal transmitting medium, the mutual mating state of both of the connectors is maintained well, and the situation that one of the connectors is detached/removed is prevented. Moreover, no tapered surface for allowing inclined mating of both of the connectors like conventional cases is formed on the insulating housing, which retains the outer-side contact. Therefore, correspondingly, a sufficient thickness of the insulating housing is ensured, the strength of the insulating housing is improved, and durability/reliability with respect to mating operations are improved.

Moreover, the present invention can be configured so that lock parts having a mutual engagement relation are provided respectively on the inner peripheral surface of the outer side contact and an outer-peripheral surface of the inner-side contact; the lock part provided on the inner-side contact is formed so as to form an annular projected shape projected from the outer peripheral surface of the inner-side contact to the outer side of the radial direction; and the lock part provided on the outer-side contact is formed so as to form an annular recessed shape recessed from the inner peripheral surface of the outer-side contact to the outer side of the radial direction.

Moreover, the present invention can be configured so that the outer-side contact constitutes part of the plug connector, and the inner-side contact constitutes part of the receptacle connector.

As described above, in the coaxial electric connector according to the present invention, the insertion reference surface having the predetermined outer-diameter size D1 is provided to extend by the predetermined length L in the axial direction on the outer peripheral surface of the inner-side contact among both of the cylindrical contacts having a positional relation mutually overlapped in the inside/outside of the radial direction. The inner peripheral surface of the outer-side contact has a mutually-mated relation having the inner-diameter size D2 (D2≈D1) approximately same as the outer-diameter size D1 of the insertion reference surface of the inner-side contact. When both of the connectors are to be mated with each other, the outer-side contact can be smoothly inserted while carrying out positioning by the insertion reference surface of the inner-side contact, the inserting operation of the outer-side contact is stably and precisely carried out, the insertion force is suppressed to be small, the positional stability upon mating mutually between both of the connectors is improved, so-called inclined mating is prevented, a good mating state is obtained, and an electrical contact state is improved. Therefore, the mating operation mutually between the connectors can be easily and precisely carried out, and reliability of the coaxial electric connector can be significantly improved at low cost.

DETAILED DESCRIPTION OF THE PREFERRED EMBODIMENTS

Figure 1:
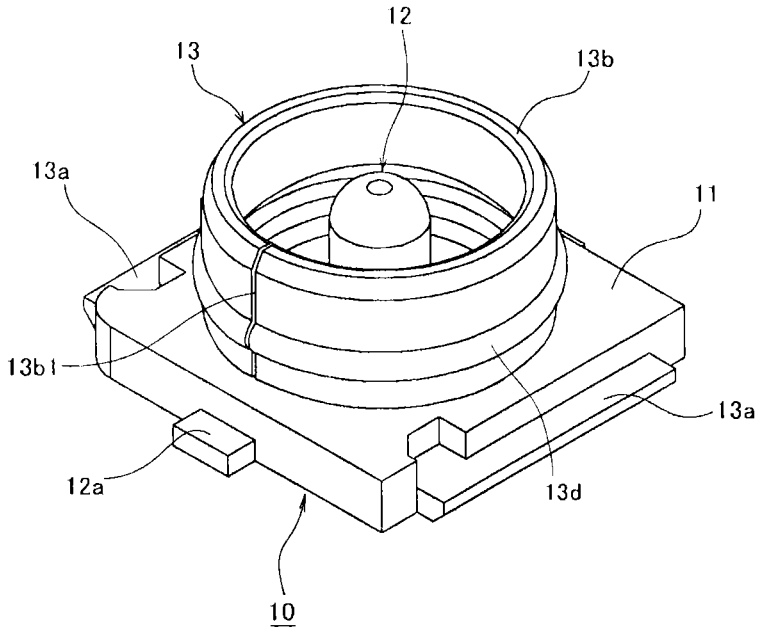
FIG. 1 is an external-appearance perspective-view explanatory drawing showing the structure of a receptacle connector constituting one of coaxial electric connectors according to an embodiment of the present invention.
Figure 2:
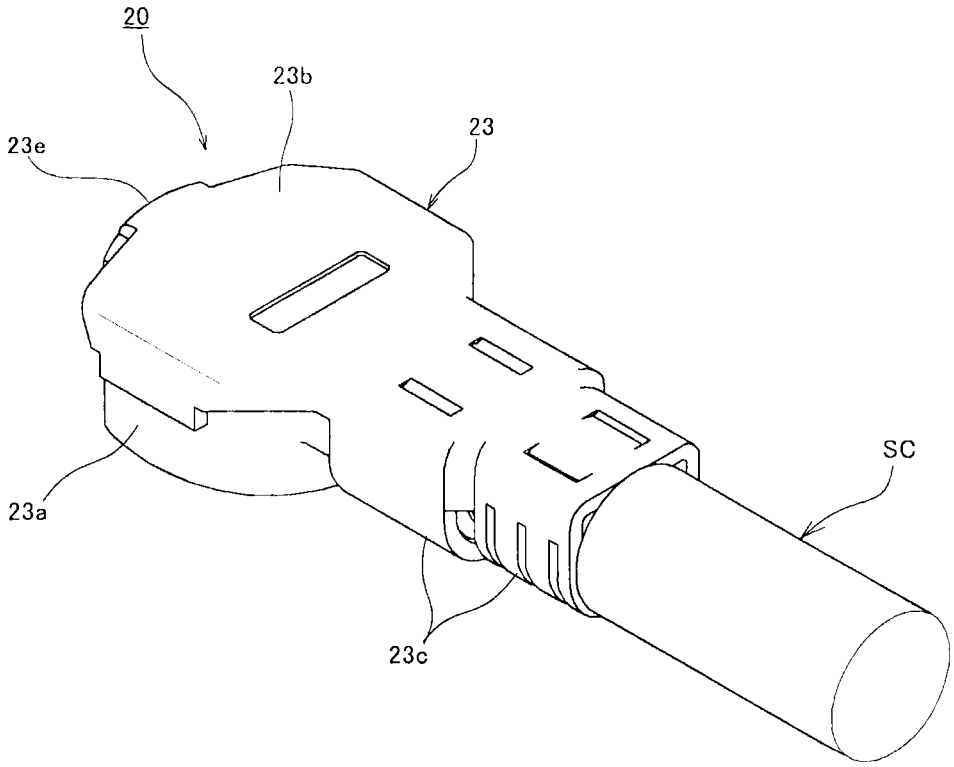
FIG. 2 is an external-appearance perspective-view explanatory drawing showing the structure of a plug connector constituting the other one of the coaxial electric connector according to the embodiment of the present invention.
Figure 3:
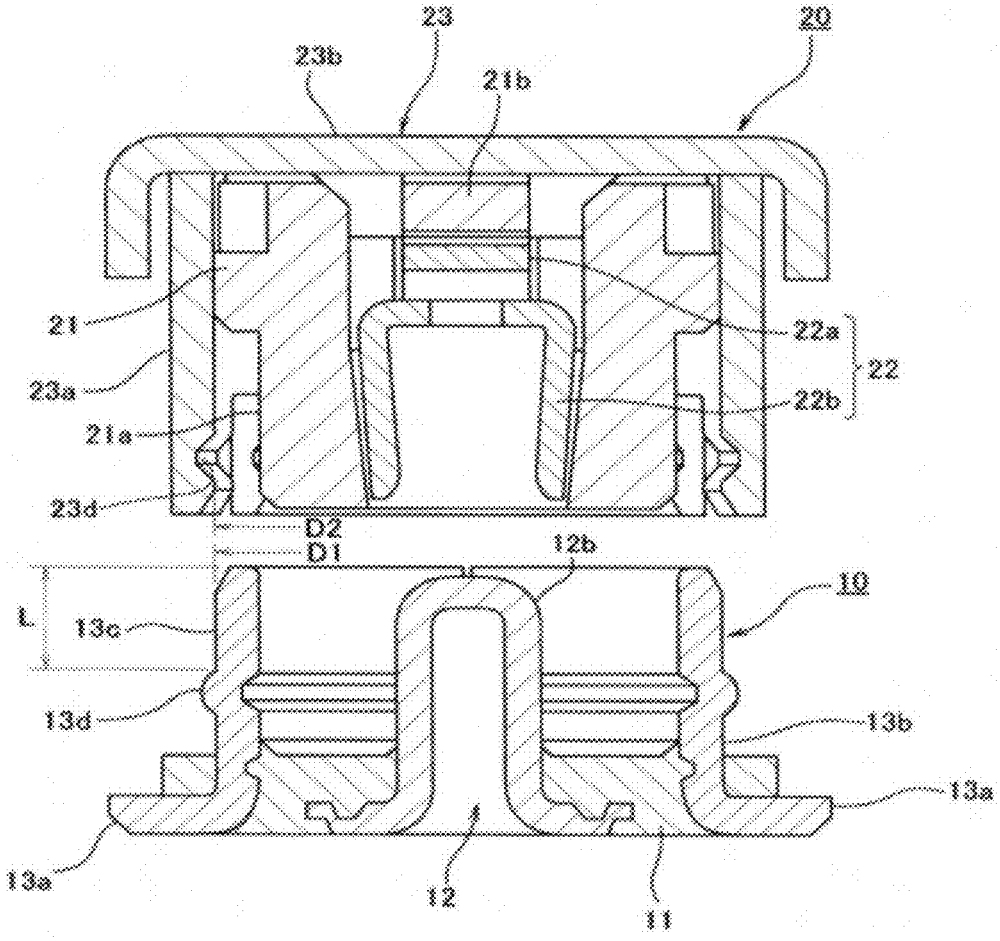
FIG. 3 is a transverse cross-sectional explanatory drawing showing a state immediately before mating of the plug connector and the receptacle connector, wherein the drawing is taken in a direction orthogonal to the axial direction of a coaxial cable.
Figure 4:
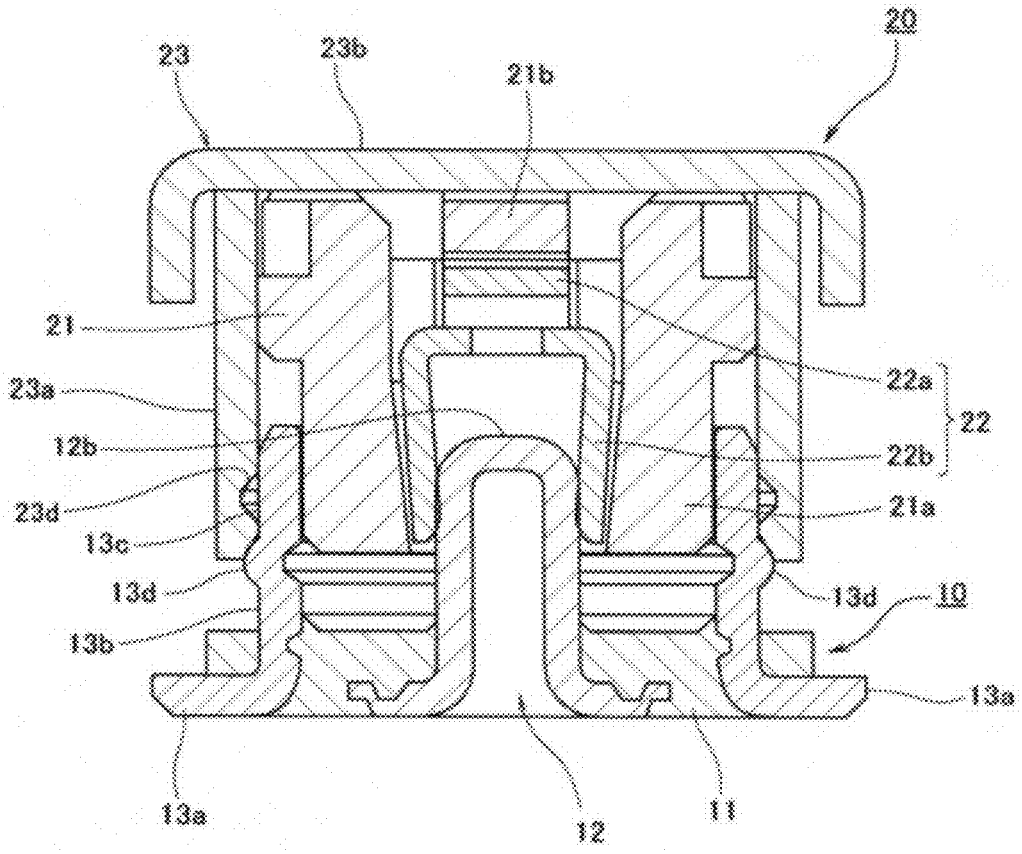
FIG. 4 is a transverse cross-sectional explanatory drawing showing a state in which the plug connector is inserted to a tentative insertion position of the receptacle connector, wherein the drawing is taken in a direction orthogonal to the axial direction of the coaxial cable.
Figure 5:
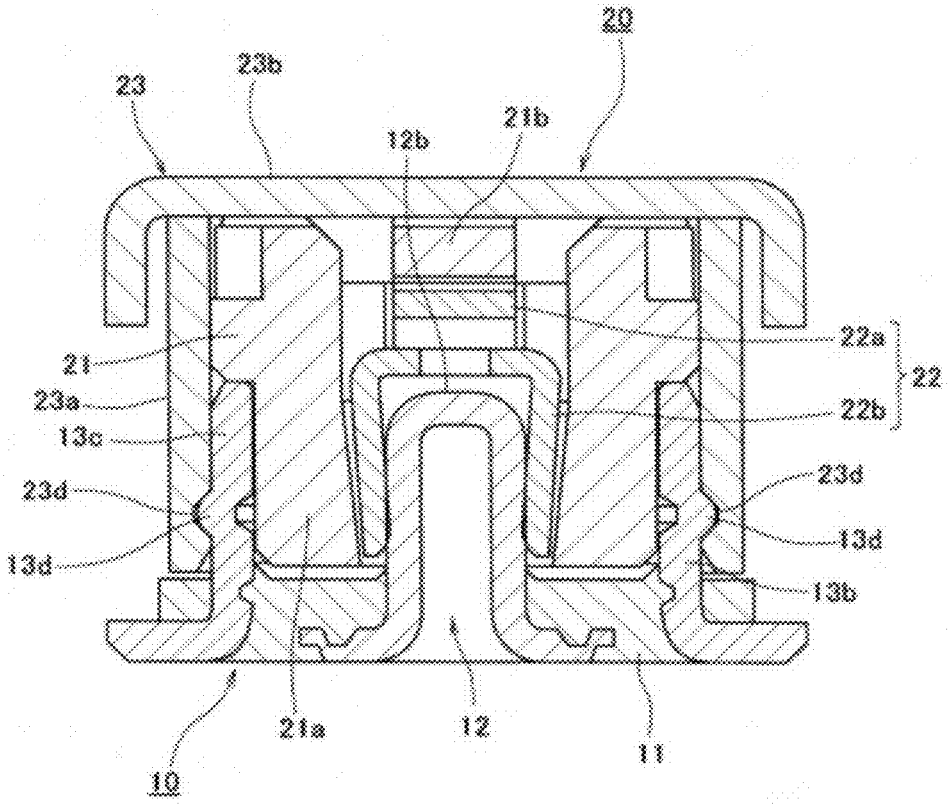
FIG. 5 is a transverse cross-sectional explanatory drawing showing a state in which the plug connector and the receptacle connector are mated with each other, wherein the drawing is taken in a direction orthogonal to the axial direction of the coaxial cable.

Hereinafter, embodiments of the present invention will be explained in detail based on drawings.

First, the assembly of a coaxial electric connector according to a first embodiment of the present invention shown in FIG. 1 to FIG. 6 is composed of a receptacle connector 10 (see FIG. 1) of a vertical-mating type mounted on a printed wiring board (illustration omitted) and a plug connector 20 (see FIG. 2) serving as an opposing connector thereof. With respect to the receptacle connector 10, the plug connector 20 can be mated from the upper side or removed. Hereinafter, the mating direction of inserting the plug connector 20 into the receptacle connector 10 will be referred to as "downward direction", and the opposite removing direction of removing that will be referred to as "upward direction".

[About Receptacle Connector]

The receptacle connector 10 constituting one of mating bodies of such a coaxial electric connector is provided with an insulating housing (dielectric body) 11 composed of an insulating plate-like member having an approximately rectangular shape in plane. A center contact (signal contact) 12 and an external contact (ground contact) 13 composed of a hollow cylindrical contact member are approximately-concentrically fixed to the insulating housing 11 by insert molding. The center contact 12 and the external contact 13 are used for signal transmission and grounding, respectively, and are respectively provided with solder connection terminal parts 12*a* and 13*a* buried in the above described insulating housing 11 and mating contact parts 12*b* and 13*b* provided so as to be continued from the solder connection terminal parts 12*a* and 13*a*.

The solder connection terminal parts 12*a* and 13*a* provided in the center contact 12 and the external contact 13 are formed of a plate-like member extending approximately horizontally in the state in which the parts are exposed from a lower surface of the insulating housing 11, and the three solder connection terminal parts 13*a* are extending in three directions which are different from the direction in which the integrated solder connection terminal part 12*a* is extending. The lower surfaces of the solder connection terminal parts 12*a* and 13*a* are disposed so as to be exposed to the lower side while forming an approximately the same plane with the lower surface of the insulating housing 11, and the lower surfaces have an arrangement relation that the parts are in contact with the surface of the above described printed wiring board (illustration omitted). The distal-end parts of the extending side of the solder connection terminal parts 12*a* and 13*a* are formed so as to project outward from lateral wall surfaces of the insulating housing 11, and the distal-end surfaces of the outer-side projected parts are configured to be soldered with electrically-conductive paths on the printed wiring board.

On the other hand, the mating contact parts 12*b* and 13*b* are formed so as to rise upward approximately at right angle from far-side end parts of the solder connection terminal parts 12*a* and 13*a* approximately horizontally extending in the above described manner, and the mating contact parts 12*b* and 13*b* are formed so as to be projected vertically upward from the upper-side surface of the insulating housing 11. Among them, the mating contact part 12*b* constituting part of the center contact 12 is formed of a hollow pin-like member of which transverse cross section in the horizontal direction forms an approximately circular shape, and the mating contact part 13*b* composed of the hollow cylindrical member constituting part of the external contact 13 is disposed so as to concentrically surround the mating contact part 12*b* of the center contact 12. Later-described corresponding parts of the plug connector 20 serving as the opposing connector are mated with or removed from the mating contact part 12*b* of the center contact 12 and the mating contact part 13*b* of the external contact 13, respectively.

A cut gap part 13*b*1 by which the hollow cylindrical member is discontinuous in a circumferential direction is provided in the hollow cylindrical member constituting the mating contact part 13*b* of the above described external contact 13 so as to extend in the axial direction. The mating contact part 13*b* can be elastically displaced in the circumferential direction by the amount of the gap of the cut gap part 13*b*1.

[About Plug Connector]

On the other hand, the plug connector 20 constituting the connector of the other side of the mating bodies of the coaxial electric connector according to the present embodiment is a vertical-mating type connector mated with the receptacle connector 10 from the upper side as described above, and a terminal part of a thin-line coaxial cable SC serving as a signal transmitting medium is coupled to an insulating housing 21 of the plug connector 20. Hereinafter, an end part of the side in which the thin-line coaxial cable SC is coupled to the plug connector 20 is referred to as "rear end part", an end part in the opposite side thereof is referred to as "front end part", and the directions toward the rear end part and the front end part are referred to as "rear" and "front", respectively.

The insulating housing (dielectric body) 21 of the plug connector 20 is provided with a main-body insertion guide part 21*a* which approximately forms a cylindrical shape and is projected downward. The outer peripheral surface of the main-body insertion guide part 21*a* has an outer-diameter size slightly smaller with respect to the inner peripheral surface of the external contact 13 of the above described receptacle connector 10, so that the main-body insertion guide part 21*a* of the plug connector 20 slides downward along the inner peripheral surface of the external contact 13 of the receptacle connector 10 when both of the connectors 10 and 20 are mated with each other.

A center contact (signal contact) 22 for signal transmission is disposed at an upper-end-side center part of the insulating housing 21 provided in the plug connector 20, and an electrically-conductive shell 23 composed of a thin metal plate member is attached to the outer-side surface of the insulating housing 21. Among them, the electrically-conductive shell 23 is provided with, as a shell main-body part, an external contact 23*a* composed of a hollow cylindrical contact member annularly covering the main-body insertion guide part 21*a* of the above described insulating housing 21 from the outer side. Above the external contact 23*a*, a shell cover part 23*b* covering the upper-end opening part of the external contact 23*a* and the insulating housing 21 from the upper side is integrally and continuously provided.

The external contact 23*a* constituting the shell main-body part of the electrically-conductive shell 23 is formed of a cylindrical member having a comparatively large diameter and is configured to be mated with the outer side of the external contact 13 when mated with the above described receptacle connector 10. More specifically, the distal-end opening part of the external contact 23*a* serving as a cylindrical contact in the plug connector 20 is configured to be inserted to the distal-end opening part of the external contact 13 serving as a cylindrical contact in the above described receptacle connector 10 so as to be approximately concentrically overlapped in the outer/inner position relation in the radial direction.

In this manner, in the present embodiment, both of the connectors 10 and 20 mutually form approximately concentric shapes in a mated state; wherein, the external contact 23*a* of the plug connector 20 is positioned in the outer side of the radial direction, and the external contact 13 of the receptacle connector 10 is positioned in the inner side of the radial direction. Therefore, the "outer-side contact" referred to in the present invention is the external contact 23*a* of the plug connector 20, and the external contact 13 of the receptacle connector 10 corresponds to the "inner-side contact" referred to in the present invention. Therefore, hereinafter, the external contact 23*a* of the plug connector 20 is referred to as "outer-side contact", and the external contact 13 of the receptacle connector 10 is referred to as "inner-side contact". Detailed configurations of the outer-side contact 23*a* and the inner-side contact 13 will be described later.

On the other hand, the shell cover part 23*b* constituting part of the electrically-conductive shell 23 has a covering configuration so as to cover the upper-end-side opening part of the above described outer-side contact (external contact) 23*a* from the upper side. In the rear-end-side part of the shell cover part 23*b*, a cable supporting part 23*c* having an approximately semicircular shape as a vertical cross section is provided so as to project approximately horizontally toward the rear side. The terminal part of the above described thin-line coaxial cable SC is maintained by the cable supporting part 23*c*.

On the other hand, an outer-peripheral covering material is peeled off to expose the terminal part of the thin-line coaxial cable SC serving as the above described signal transmitting medium so that a cable center conductor (signal line) SCa and a cable external conductor (shield line) SCb form concentric shapes. The cable center conductor SCa disposed along the center axial line of the thin-line coaxial cable SC is connected to the center contact (signal contact) 22 attached to the insulating housing 21 so as to form a signal circuit. The cable external conductor SCb disposed so as to surround the outer peripheral side of the cable center conductor SCa is retained so as to be in contact with the shell cover part 23*b* of the electrically-conductive shell 23, and the shell cover part 23*b* is continued to the outer-side contact 23*a* so as to form a ground circuit.

Herein, in an initial state before the terminal part of the thin-line coaxial cable SC is coupled and fixed, the shell cover part 23*b* of the above described electrically-conductive shell 23 is in a state that it is open to the upper side. More specifically, the shell cover part 23*b* in the initial state is disposed so as to rise upward approximately vertically via a connecting member 23*e* composed of a narrow member in the opposite side of the above described cable supporting part 23*c*, in other words, in the front-end-side part of the outer-side contact 23*a* serving as a shell main body part. In the inner side of the shell cover part 23*b*, an insulating pressing plate 21*b* rising upward from the main-body insertion guide part 21*a* of the above described insulating housing 21 is disposed along the inner surface of the shell cover part 23*b*.

Then, after the terminal part of the thin-line coaxial cable SC is placed and set so as to be received by the cable supporting part 23*c* in the initial open state of the electrically-conductive shell 23, the shell cover part 23*b* is turned and pushed down to an approximately horizontal state so that the connecting member 23*e* is bent at approximately right angle together with the insulating pressing plate 21*b*. As a result, the main-body insertion guide part 21*a* of the insulating housing 21 and the upper-end opening part of the outer-side contact 23*a* of the electrically-conductive shell 23 are covered with the shell cover part 23*b* from the upper side, and the insulating housing 21 and the electrically-conductive shell 23 become a closed state. The cable supporting part 23*c* of the shell cover part 23*b* has a covering configuration so as to cover the outer part of the above described thin-line coaxial cable SC from the upper-side part, both-side plate-like members of the shell cover part 23*b* are bent toward the inner side and fixed by caulking, and the cable external conductor SCb is brought into contact with the cable supporting part 23*c;* as a result, a ground circuit by the electrically-conductive shell 23 is formed.

Figure 6:
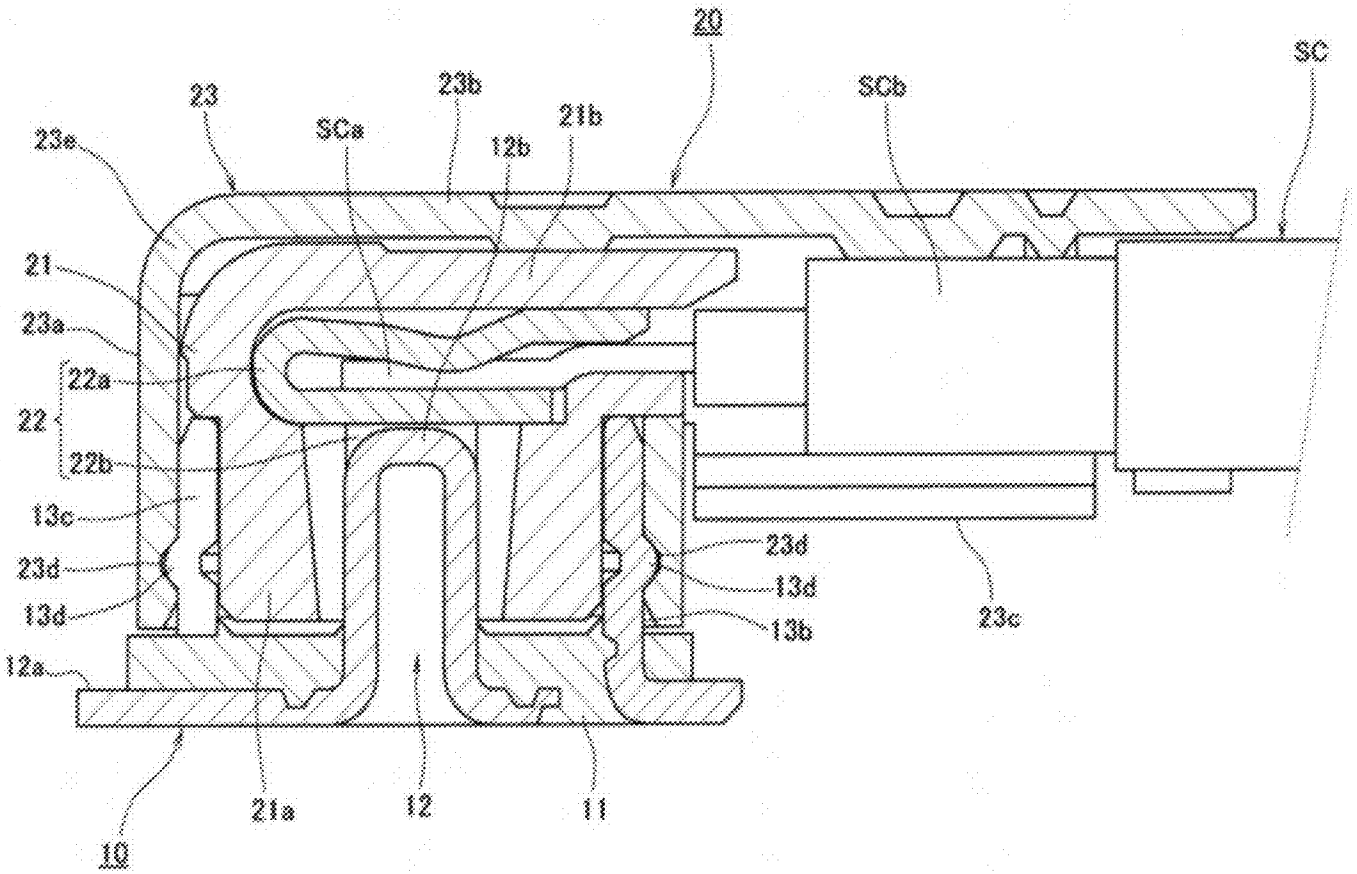
FIG. 6 is a vertical cross-sectional explanatory drawing showing a state in which the plug connector and the receptacle connector are mated with each other, wherein the drawing is taken along the axial direction of the coaxial cable.

The center contact (signal contact) 22 provided in the plug connector 20 is attached to the main-body insertion guide part 21*a* of the insulating housing 21 by press-fitting, insert molding, or the like. Particularly, as shown in FIG. 6, the center contact 22 has a cable sandwiching part 22*a*, which is connected to the cable center conductor (signal line) SCa of the above described thin-line coaxial cable SC, and a contact part 22*b*, which is extending from the cable sandwiching part 22*a* toward the lower side and is brought into contact with the center contact 12 of the receptacle connector 10 as described above.

Among them, the cable sandwiching part 22*a* has a clip beam structure formed by bending so that the shape thereof in a lateral view has a shape in which an approximately U-shape is transversely laid down, and the cable sandwiching part is formed so as to sandwich the cable center conductor (signal line) SCa of the thin-line coaxial cable SC from the top and bottom like a clip. At an intermediate part of an upper-side beam part constituting the cable sandwiching part 22*a*, a downward projection part, which presses the cable center conductor (signal line) SCa from the upper side, is provided.

In the initial state before coupling the terminal part of the above described thin-line coaxial cable SC, the upper-side beam part of the cable sandwiching part 22*a* is also in the state in which it is open to the upper side. More specifically, the upper-side beam part of the cable sandwiching part 22*a* in the initial open state has a shape obliquely rising upward. When the shell cover part 23*b* of the electrically-conductive shell 23 is pushed down together with the insulating pressing plate 21*b* in the above described manner from the state in which the terminal part of the thin-line coaxial cable SC is placed and set on the cable supporting part 23*c* to an approximately horizontal state, the upper-side beam part of the cable sandwiching part 22*a* is configured to be pushed down by the insulating pressing plate 21*b* to the approximately horizontal state and press the cable center conductor (signal line) SCa from the upper side.

The contact part 22*b* of the center contact (signal contact) 22 is formed of a hollow member press-fitted from the outer side with respect to the center contact (signal contact) 12 of the above described receptacle connector 10, and is extended so as to form an approximately reversed U-shape in a transverse section while forming a cantilever-shape downward from the above described cable sandwiching part 22*a*, and is configured to be pressure-joined with the center contact 12 of the receptacle connector 10 by an elastic displacement effect of the contact part 22*b*.

[About Configuration of Cylindrical Contact]

As described above, in the present embodiment, the outer-side contact (external contact) 23*a* constituting the cylindrical contact of the plug connector 20 is configured to be mated with, in an approximately-concentrically overlapped positional relation, the outer side of the inner-side contact (external contact) 13 constituting the cylindrical contact of the receptacle connector 10. In such a mating relation, in the inner-side contact 13 of the receptacle connector 10, an insertion reference surface 13*c* having a predetermined outer-diameter size D1 is formed at an upper-side distal-end opening part of the outer peripheral surface of the contact 13. The insertion reference surface 13*c* is provided so as to extend downward in the axial direction by a predetermined length L from an upper-side distal-end opening edge of the inner-side contact 13, and the lock part 13*d* is provided at a lower end position of the insertion reference surface 13*c* of the receptacle connector 10. The lock part 13*d* is provided so as to form an annular projected shape projected from the outer-peripheral surface of the inner-side contact 13 to the outer side in the radial direction.

The outer-side contact 23*a* of the plug connector 20 is externally mated with the outer side of the insertion reference surface 13*c* of the receptacle connector 10, and the inner peripheral surface of the lower-end-side distal-end opening part of the outer-side contact 23*a* is configured to be inserted so as to be in contact with the outer peripheral surface of the insertion reference surface 13*c*. More specifically, in the outer-side contact 23*a* of the plug connector 20, an inner-diameter size D2 of the inner peripheral surface at the lower-end-side distal-end opening part to be inserted to the receptacle connector 10 side is formed to have an approximately same size (D2≈D1) as the outer-diameter size D1 of the insertion reference surface 13*c* provided in the receptacle connector 10 side. By virtue of this, when both of the connectors 10 and 20 are to be mated with each other, a mutual mating relation between the approximately-same diameters is set to be carried out.

A lock part 23*d* to be mated with the lock part 13*d* provided in the above described receptacle connector 10 side is provided on the inner peripheral surface of the lower-end-side distal-end opening part by which the outer-side contact 23*a* of the plug connector 20 is to be inserted to the receptacle connector 10 side. The lock part 23*d* is provided so as to form an annular recessed shape recessed from the inner peripheral surface of the outer-side contact 23*a* to the outer side of the radial direction.

According to the present invention having such a configuration, when both of the connectors 10 and 20 are to be mated with each other, first, the inner peripheral surface of the outer-side contact 23*a* of the plug connector 20 is smoothly inserted while being positioned by the insertion reference surface 13*c* provided to have the approximately same size at the outer peripheral surface of the inner-side contact 13 of the receptacle connector 10. Therefore, unlike conventional cases, the plug connector 20 is not inclined with respect to the axial direction of the receptacle connector 10, and the outer-side contact 23*a* is not pushed and expanded to the outer side of the radial direction. Therefore, the inserting operation of the outer-side contact 23*a* is stably and precisely carried out, and the force of insertion is suppressed to be small. As a result, positional stability upon mating between both of the connectors 10 and 20 is improved, so-called inclined mating in conventional cases is prevented, a good mating state can be obtained, and an electrical contact state is improved.

In the present embodiment, the insertion guide part 21*a* of the insulating housing 21 to which the outer-side contact 23*a* of the receptacle connector 20 is attached is provided in the radial-direction inner side of the outer-side contact 23*a*, and the outer peripheral surface of the insertion guide part 21*a* is formed so as to form an approximately cylindrical shape extending in the approximately axial direction along the inner peripheral surface of the inner-side ground contact 13 of the receptacle connector 10. Therefore, when both of the connectors 10 and 20 are to be mated with each other, the state in which the inner-side contact 13 is sandwiched between the outer-side contact 23*a* and the insertion guide part 21 a provided in the insulating housing 21 retaining the outer-side contact 23*a* is achieved, and the state in which movement of both of the connectors 10 and 20 is restricted after mating is achieved. As a result, for example, even when external force caused by, for example, so-called tilting is applied via the signal transmitting medium, the mated state mutually between both of the connectors 10 and 20 is well maintained, and the situation that one of the connectors is detached/removed is prevented. Moreover, no tapered surface for allowing conventional inclined mating of both of the connectors 10 and 20 is not formed on the insulating housing 21, which retains the outer-side contact 23*a* of the plug connector 20. Therefore, correspondingly, a sufficient thickness of the insulating housing 21 is ensured, the strength of the insulating housing 21 is improved, and the durability/reliability with respect to the mating operation are improved.

Figure 7:
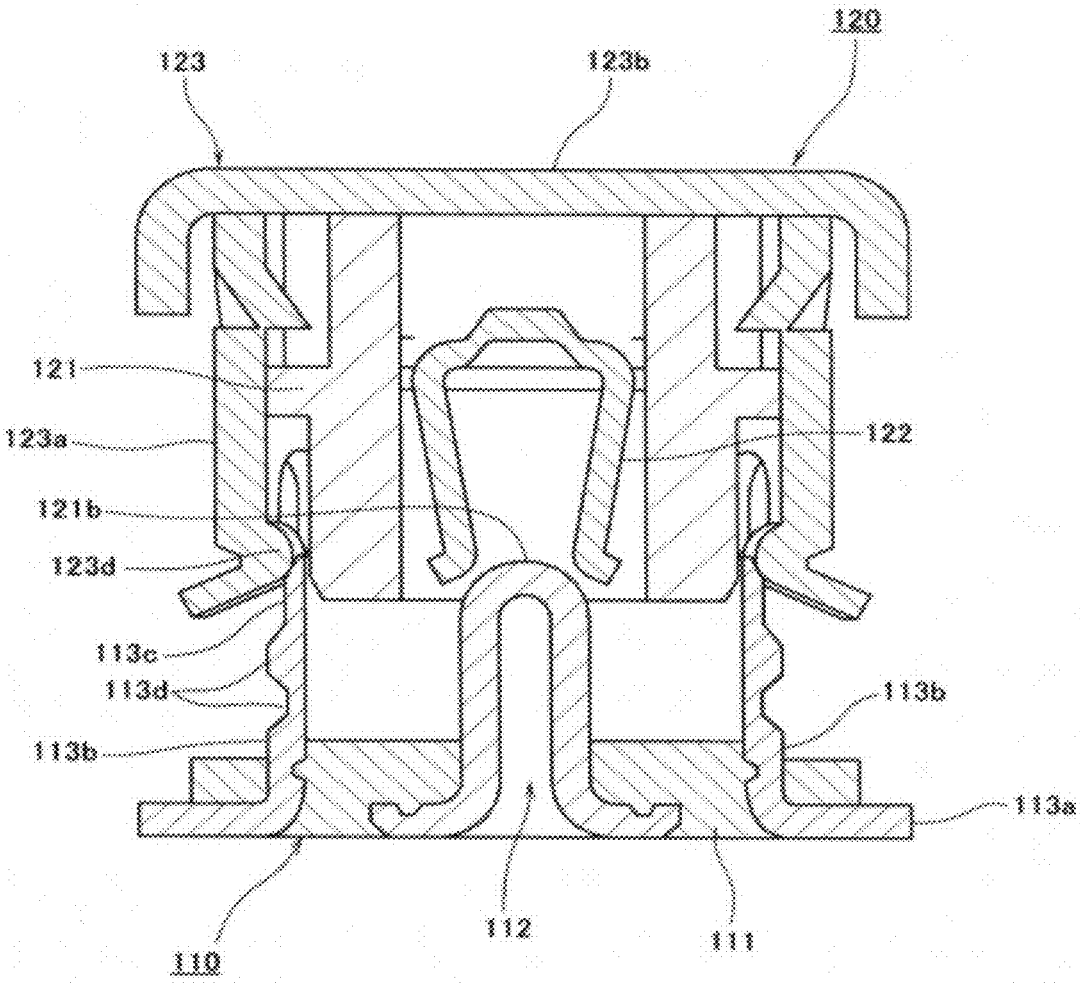
FIG. 7 is a transverse cross-sectional drawing showing a state before mating of a receptacle connector and a plug connector constituting a coaxial electric connector according to another embodiment of the present invention, wherein the drawing is taken in a direction orthogonal to the axial direction of the coaxial cable.
Figure 8:
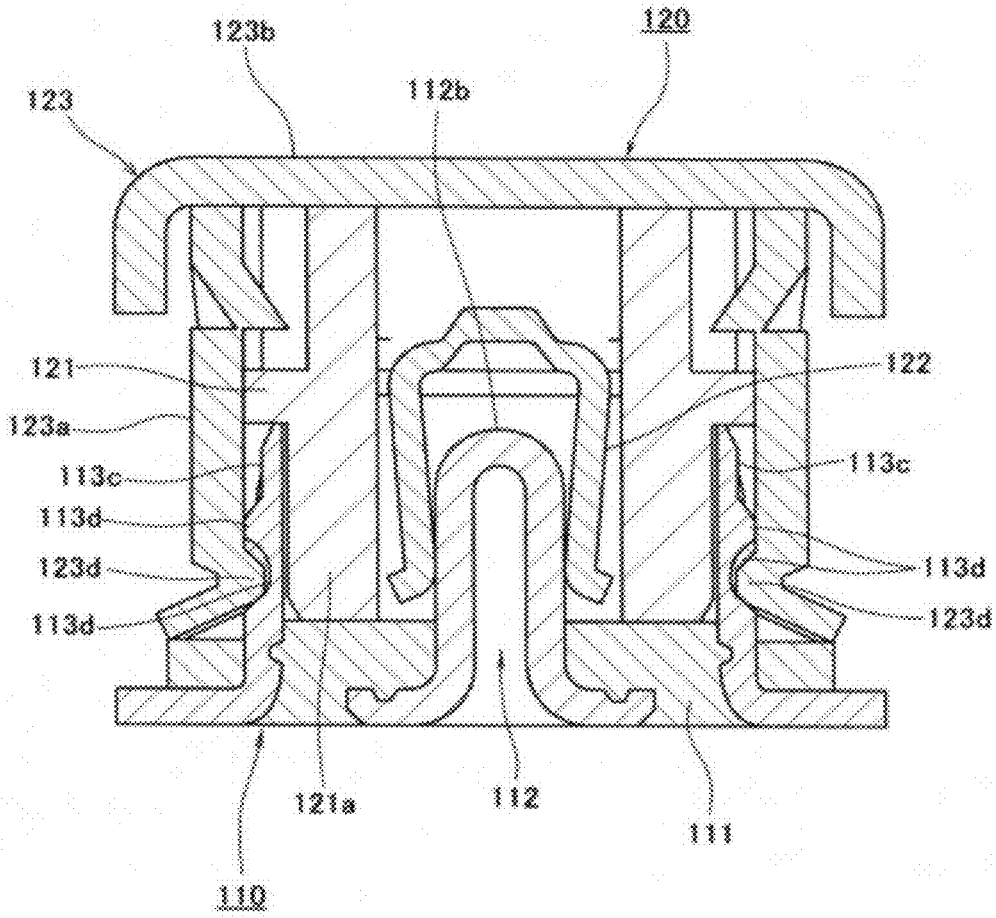
FIG. 8 is a transverse cross-sectional view showing a state in which the receptacle connector and the plug connector constituting the coaxial electric connector according to the other embodiment of the present invention, wherein the drawing is taken in a direction orthogonal to the axial direction of the coaxial cable.
Figure 9:
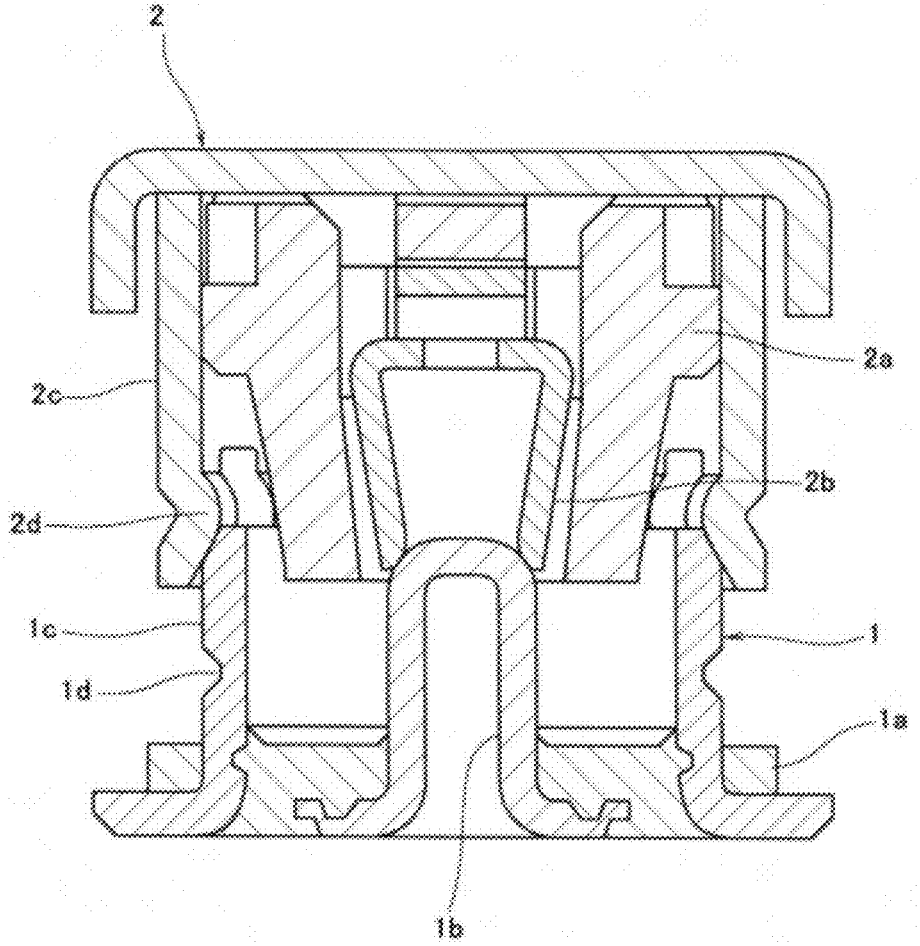
FIG. 9 is a transverse cross-sectional explanatory drawing showing a conventional state immediately before mating between a plug connector and a receptacle connector, wherein the cross section is taken in a direction orthogonal to the axial direction of a coaxial cable.
Figure 10:
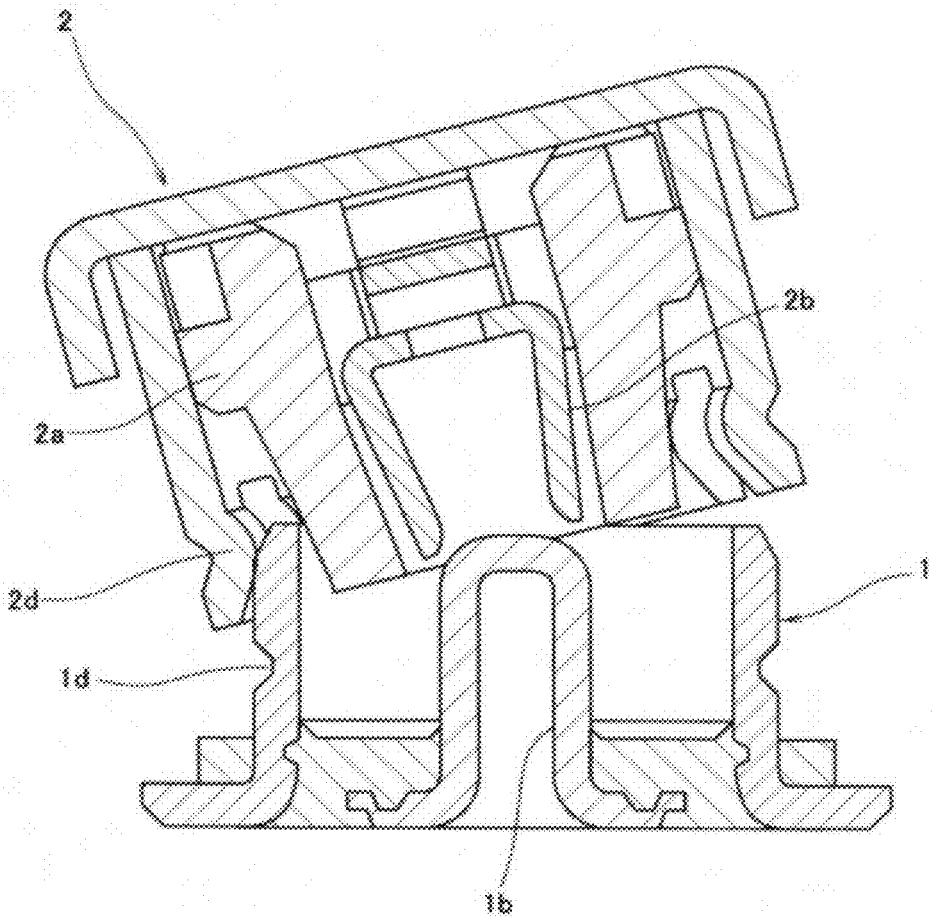
FIG. 10 is a transverse cross-sectional explanatory drawing showing a conventional state of inclined insertion in a mating operation of the plug connector and the receptacle connector, wherein the cross section is taken in a direction orthogonal to the axial direction of the coaxial cable.

On the other hand, in a second embodiment according to FIG. 7 and FIG. 8 including denotation with reference numerals obtained by adding "100" to each of the reference numerals showing the constituent members corresponding to the above described first embodiment, an insertion reference surface 113*c* provided on a receptacle connector 110 has a narrow-diameter structure having a comparatively-small outer diameter. As a result, setting is implemented so that a mating relation mutually between the approximately same diameters is carried out when both of the connectors 110 and 120 are to be mated with each other.

A lock part 123*d* forming an annularly projected shape is provided on the inner peripheral surface of an outer-side contact 123*a* of the plug connector 120, and a lock part 113*d* composed of a combination of a projected shape and a recessed shape adjacent to each other in the axial direction is provided on the outer peripheral surface of an inner-side contact 113 of the receptacle connector 110. The lock part 113*d* of the receptacle connector 110 side is configured so that an annular recessed shape part is formed at a position immediately below the annular projected shape part in the axial direction disposed in the upper side of the axial direction.

According to such an embodiment, when both of the connectors 110 and 120 are to be mated with each other, the projected-shape-forming lock part 123*d* in the plug connector 120 side is moved so as to move over the lock part 113*d* composed of the projected/recessed shapes in the receptacle connector 110 side. Therefore, a so-called clicking feeling upon mating can be strongly obtained.

The invention accomplished by the present inventor has been specifically explained above based on the embodiments. However, the present embodiments are not limited to the above described embodiments, and it goes without saying that various changes can be made without departing from the gist thereof.

For example, in the above described embodiments, the present invention is applied to an electric connector of a vertical-mating type. However, the present invention can be similarly applied also to an electric connector of a horizontal-mating type.

Furthermore, the present invention is not limited to a connector for a single thin-line coaxial cable like the above described embodiments, but can be similarly applied to: for example, a connector for thin-film coaxial cables disposed in a multipolar manner, an electric connector of a type in which a plurality of thin-film coaxial cables and insulating cables are mixed, and an electric connector coupled to a flexible wiring board, etc.

As described above, the present embodiments can be widely applied to a wide variety of coaxial electric connectors used in various electric devices.

What is claimed is:

1. A coaxial electric connector configured so that a receptacle connector mounted on a printed wiring board and a plug connector coupled to a terminal part of a signal transmitting medium can be mutually mated/removed and configured so that a distal-end opening part of a cylindrical contact constituting the plug connector is inserted to a distal-end opening part of a cylindrical contact constituting the receptacle connector so as to be overlapped in inside/outside of a radial direction; wherein an insertion reference surface having a predetermined outer-diameter size D1 is formed to extend by a predetermined length L in an axial direction on an outer peripheral surface of an inner-side contact positioned in the inner side of a radial direction among both of the cylindrical contacts; and a mating relation is set so that an inner peripheral surface of the outer-side contact positioned in the outer side of the radial direction among both of the cylindrical contacts has an inner-diameter size D2 (D2≈D1) approximately same as an outer-diameter size D1 of the insertion reference surface of the inner-side contact.

2. The coaxial electric connector according to claim 1, wherein an insulating housing to which the outer-side contact is attached is provided with an approximately-cylindrical-shaped insertion guide part extending in an axial direction along the inner peripheral surface of the inner-side contact.

3. The coaxial electric connector according to claim 1, wherein lock parts having a mutual engagement relation are provided respectively on the inner peripheral surface of the outer-side contact and the outer-peripheral surface of the inner-side contact;

the lock part provided on the inner-side contact is formed so as to form an annular projected shape projected from the outer peripheral surface of the inner-side contact to the outer side of the radial direction; and the lock part provided on the outer-side contact is formed so as to form an annular recessed shape recessed from the inner peripheral surface of the outer-side contact to the outer side of the radial direction.

4. The coaxial electric connector according to claim 1, wherein the outer-side contact constitutes part of the plug connector, and the inner-side contact constitutes part of the receptacle connector.

* * * * *